US005954102A

United States Patent [19]

Sato et al.

[11] Patent Number: 5,954,102

[45] Date of Patent: Sep. 21, 1999

[54] SUSPENDED TYPE FUELING SYSTEM

[75] Inventors: Yoshiyuki Sato; Shoichi Fukumoto; Yosei Terahara, all of Tokyo, Japan

[73] Assignee: Tatsuno Corporation, Tokyo, Japan

[21] Appl. No.: 08/986,518

[22] Filed: Dec. 8, 1997

[30] Foreign Application Priority Data

Dec. 9, 1996 [JP] Japan ..... 8-342349

[51] Int. Cl.[6] ..... B67D 5/06

[52] U.S. Cl. ..... 141/83; 141/59; 141/94; 141/98; 141/392; 222/14; 222/28; 222/40; 222/72

[58] Field of Search ..... 141/59, 83, 94, 141/98, 231, 392; 705/413; 137/234.6, 236.1; 222/14, 25, 28, 40, 72

[56] References Cited

U.S. PATENT DOCUMENTS

| | | | |
|---|---|---|---|
| 3,773,219 | 11/1973 | Irie et al. | 222/14 |
| 3,946,900 | 3/1976 | DuBrueler, Jr. | 222/25 |
| 4,359,074 | 11/1982 | Maruyama et al. | 141/94 |
| 4,627,553 | 12/1986 | Yoshida et al. | 222/14 |
| 4,838,323 | 6/1989 | Watts | 141/83 |
| 5,184,309 | 2/1993 | Simpson et al. | 141/392 |
| 5,209,275 | 5/1993 | Akiba et al. | 141/83 |
| 5,217,051 | 6/1993 | Simpson et al. | 141/59 |
| 5,249,612 | 10/1993 | Parks et al. | 141/94 |
| 5,363,988 | 11/1994 | Saxton et al. | 222/14 |

FOREIGN PATENT DOCUMENTS

| | | |
|---|---|---|
| 50-28016 | 3/1975 | Japan . |
| 2-166095 | 6/1990 | Japan . |
| 8-113299 | 5/1996 | Japan . |

*Primary Examiner*—J. Casimer Jacyna
*Attorney, Agent, or Firm*—Birch, Stewart, Kolasch & Birch, LLP

[57] ABSTRACT

A suspended type fueling system of the present invention is composed of an oil reservoir, fueling tube, fueling hose with a nozzle, pump on the fueling tube, pump motor for diving the pump, flow-meter, control unit, fueling operation unit on the fueling nozzle. The fueling tube is connected to the oil reservoir underground at one end and to the fueling hose at the other end. The fueling tube is extended overhead and drawn to a lower part therefrom. The fueling operation unit contains an indication member for indicating fueling data measured by the flow meter, a nozzle ascent-descent switch for transmitting nozzle ascent and descent signals to the control unit, and a combined-use-switch for suspending oil discrimination and performing a rounding off of fueling.

11 Claims, 9 Drawing Sheets

SUSPENDED TYPE FUELING SYSTEM

BACKGROUND OF THE INVENTION

1. Field of the Invention

The present invention relates to a suspended type fueling system wherein a fueling hose is suspended from a hose treating unit provided at an upper part of a fueling area in such a fashion that the hose can be ascent and descent.

2. Discussion of Background Art

A suspended type fueling system wherein a fueling hose is suspended from a hose treating unit provided at an upper part of a fueling area in such a fashion that the hose can be ascent and descent is known as Japanese Laid-Open Patent Application 2 (1990)-166095. This suspended type fueling system provides an ascent-descent switch, indictor and the like collectively on a fueling operation unit provided on a fueling nozzle in order to easily perform the fueling operation.

Moreover, a suspended type fueling system with an oil discrimination sensor is known as disclosed in Japanese Laid-Open Patent Application 8 (1996)-113299. In this type of suspended type fueling system, there is provided the oil discrimnation sensor on a fueling nozzle, and a swith for suspending the oil discrimination function is provided in a switch box at the midway of the fueling hose together with an ascent-descent switch.

Futhermore, Japanese Laid-Open Patent Application 50 (1975)-28016 discloses a fueling system by which a fueling fee without a fraction is provided, that is a so-called fueling system with a rounding off function. Fueling in which an oil quantity is rounded by a rounding off fueling signal is performed in the fueling system.

SUMMARY OF THE INVENTION

It is therefore an object of the present invention to provide a suspended type fueling system in which the fueling operation unit provided on a fueling nozzle is made smaller than a conventional nozzle and by which a different sort of oil from the oil in a vehicle's tank is prevented from being fueled, with liquidation treatment being smoothly performed by eliminating fractions from a fee for fueling.

The above object of the present invention can be achieved by a suspended type fueling system comprising an oil reservoir; a fueling tube connected to the oil reservoir at one end thereof, an extended overhead; a fueling hose connected to the fueling tube at the other end of the fueling tube; a pump provided on the fueling tube; a pump motor provided on the pump for driving the pump; a flow-meter provided on the fueling tube; a fueling nozzle provided on the fueling hose at the free end thereof; a control unit for controlling fueling, oil discrimination and rounding off fueling; and a fueling operation unit provided on the fueling nozzle, comprising an indication member for indicating fueling data measured by the flow meter, a nozzle ascent-descent switch for transmitting a nozzle ascent and descent signals to the control unit, and a combined-use-swich for suspending oil discrimination an performing rounding off fueling.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

The suspended type fueling system of the present invention comprises an oil reservoir; a fueling tube connected to the oil reservoir at one end thereof, and extended overhead; a fueling hose connected to the fueling tube at the other end of the fueling tube; a pump provided on the fueling tube; a pump motor provided on the pump for driving the pump; a flow-meter provided on the fueling tube; a fueling nozzle provided on the fueling hose at the free end thereof; a control unit for controlling fueling, oil discrimination and rounding off fueling; and a fueling operation unit provided on the fueling nozzle, comprising an indication member for indicating fueling data measured by the flow meter, a nozzle ascent-descent switch for transmitting a nozzle ascent and descent signals to the control unit, and a combined-use-switch for suspending oil discrimination and performing a rounding off of fueling.

By the suspended type fueling system of the present invention, the fueling of wrong kind of oil, that is, the fueling of oil which is different from that in a tank of an automobile or the like is eliminated by the oil discrimination function, liquidation of the fueling fee can readily be carried out because of the rounding off of fueling. Furthermore, the fueling operation unit provided on the fueling nozzle can be made small since the signals for suspending oil discrimination and for rounding off fueling are input from a single switch, whereby the fueling operation unit can be made smaller than conventional ones and the operation itself can be smoothly performed.

Moreover, fueling can smoothly be performed without performing oil discrimination especially when it is difficult to perform oil discrimination by sensing vapor in a tank for instance, of a motorcycle, according to which shape of the fueling nozzles oil that is not in a vapor state at a neck of the tank but as a liquid state at the lower part thereof is reached or when the sensor in the fueling system obviously functions in a wrong way.

In addition, rounding off fueling is performed only when a signal from the combined-use-switch is input during fueling suspension. Accordingly, fueling is never ended because of the rounding off fueling function even when the combined-use-switch is pressed while fueling is operating by mistake.

Other features of this invention will become apparent in the course of the following description of exemplary embodiments, which are given for illustration of the invention and are not intended to be limiting thereof.

Figure 1:
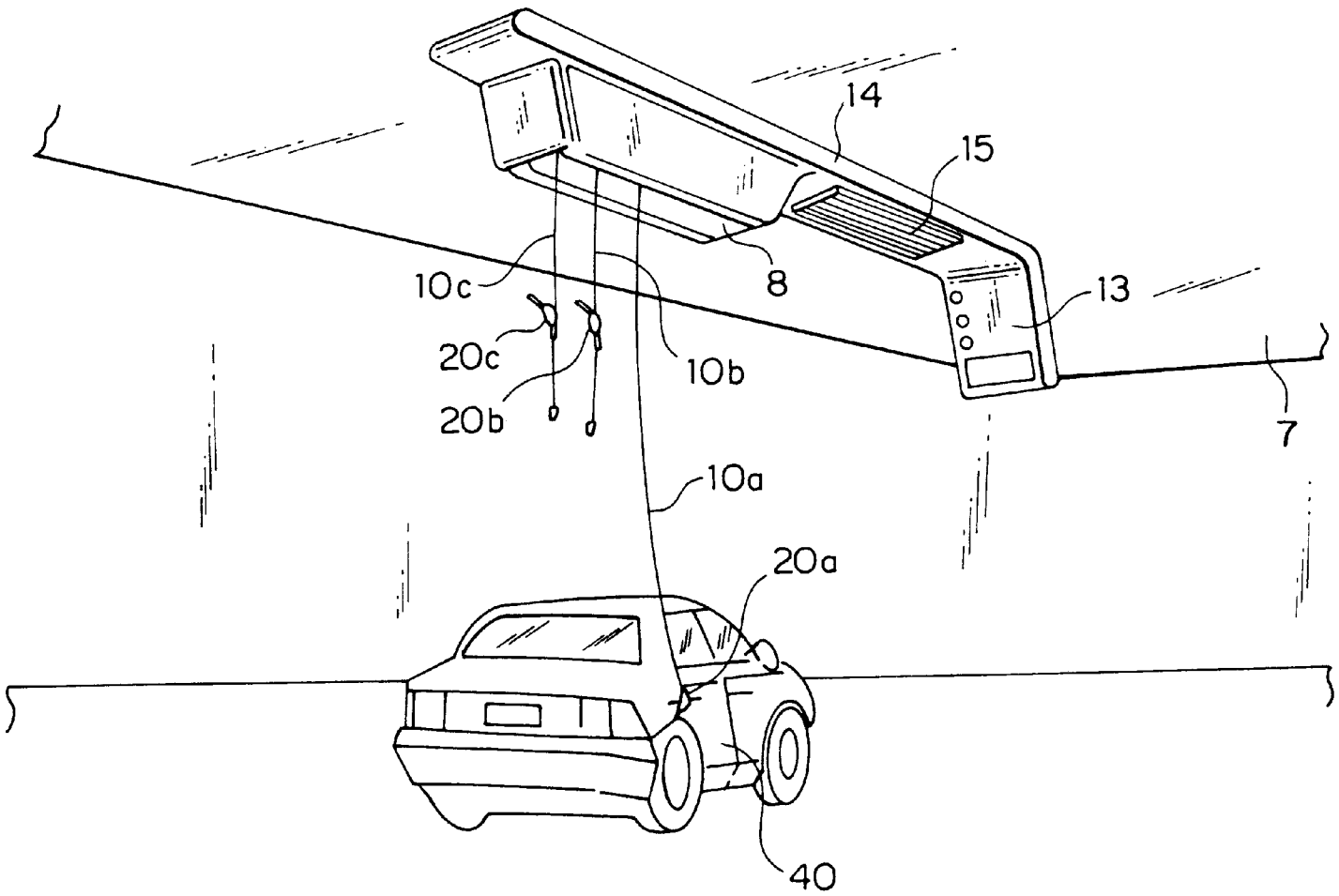
FIG. 1 is a perspective schematic view for showing a gas station to which the suspended type fueling system of the present invention is applied.

FIG. 1 is a perspective schematic view for showing a gas station to which the suspended type fueling system of the present invention is applied. In general, a gas station has a canopy 7 on which a band-formed plate 14 is provided at the lower surface thereof. There is a hose treating unit 8 provided on one end of the band-formed plate 14, a fueling amount indicator 13 on the other end thereof, and lights 15 between the hose treating unit 8 and the fueling amount indicator 13. A plurality of hoses 10*a* to 10*c* are suspended from the hose treating unit 8 with fueling nozzles 20*a* to 20*c* at the tip thereof. One of these nozzles 20*a* to 20*c* from which different sorts of oils are offered is selected to supply a predetermined sort of oil to a car 40. In FIG. 1, the fueling nozzle 20*a* is selected for fueling to the car 40.

Figure 2:
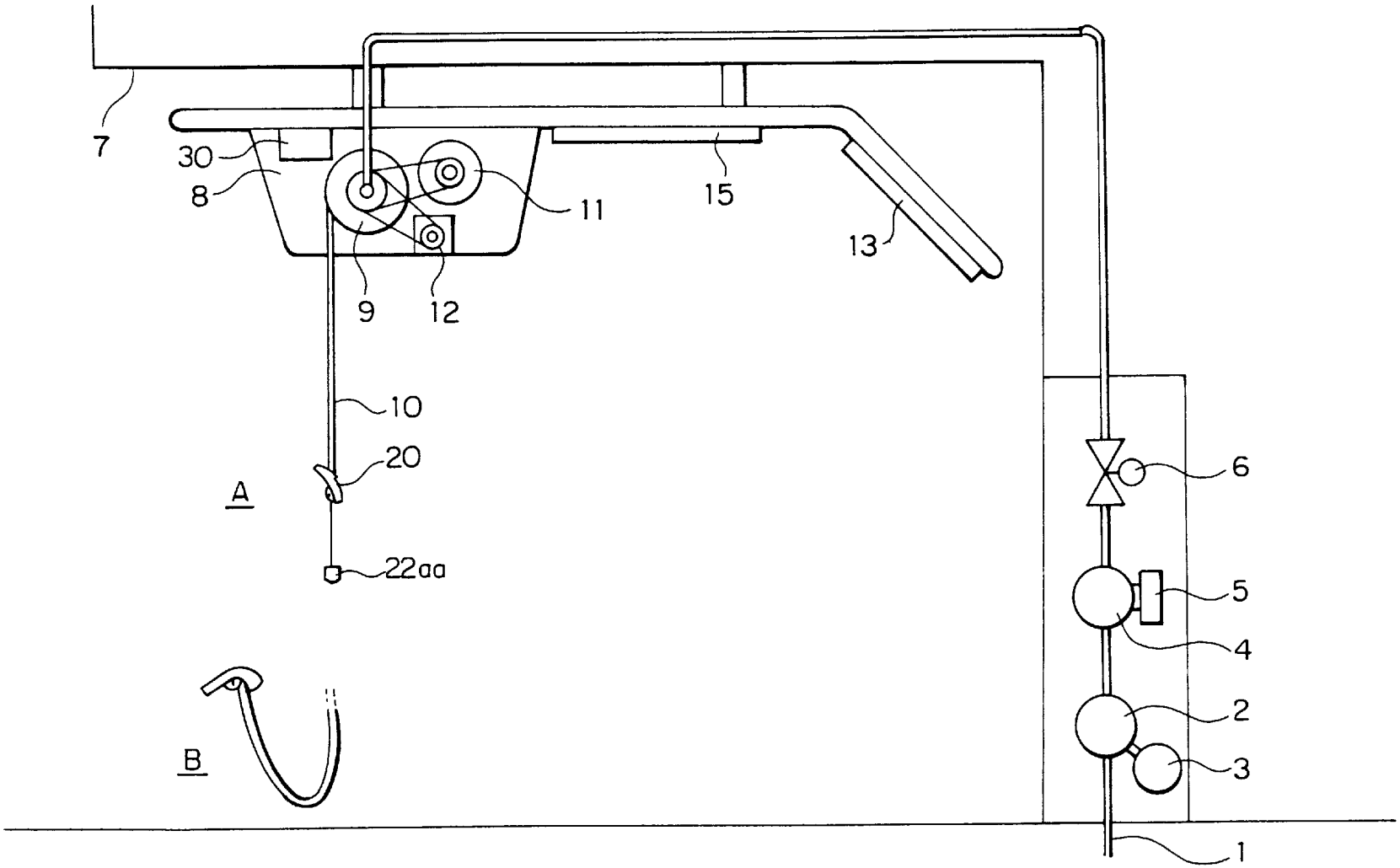
FIG. 2 is a general diagram for explaining an embodiment of a suspended type fueling system of the present invention.

FIG. 2 is a diagram for generally explaining the suspended type fueling system of the present invention. A fueling tube 1 connected to an oil reservoir (not shown) successively has a pump 2, a flow meter 4, a control valve 6 from the oil reservoir side; and a pump motor 3 is connected to the pump 2 for driving the same, and a pulse generator 5 is provided on the flow meter 4. The fueling tube 1 is extended to be provided above a canopy 7 and is connected to a fueling hose 10 wound on a hose reel 9 contained in a hose treating unit 8. The hose reel 9 is rotated by means of a reel motor 11 in the positive and negative directions. A positioning sensor 12 for detecting the positions, namely a raised position A and a fueling position B of a fueling nozzle 20 adjusted to the tip of the fueling hose 10. A fueling amount indicator 13 is provided by a wall, and a control unit 30 is provided, for instance, in the hose treating unit 8.

Figure 3:
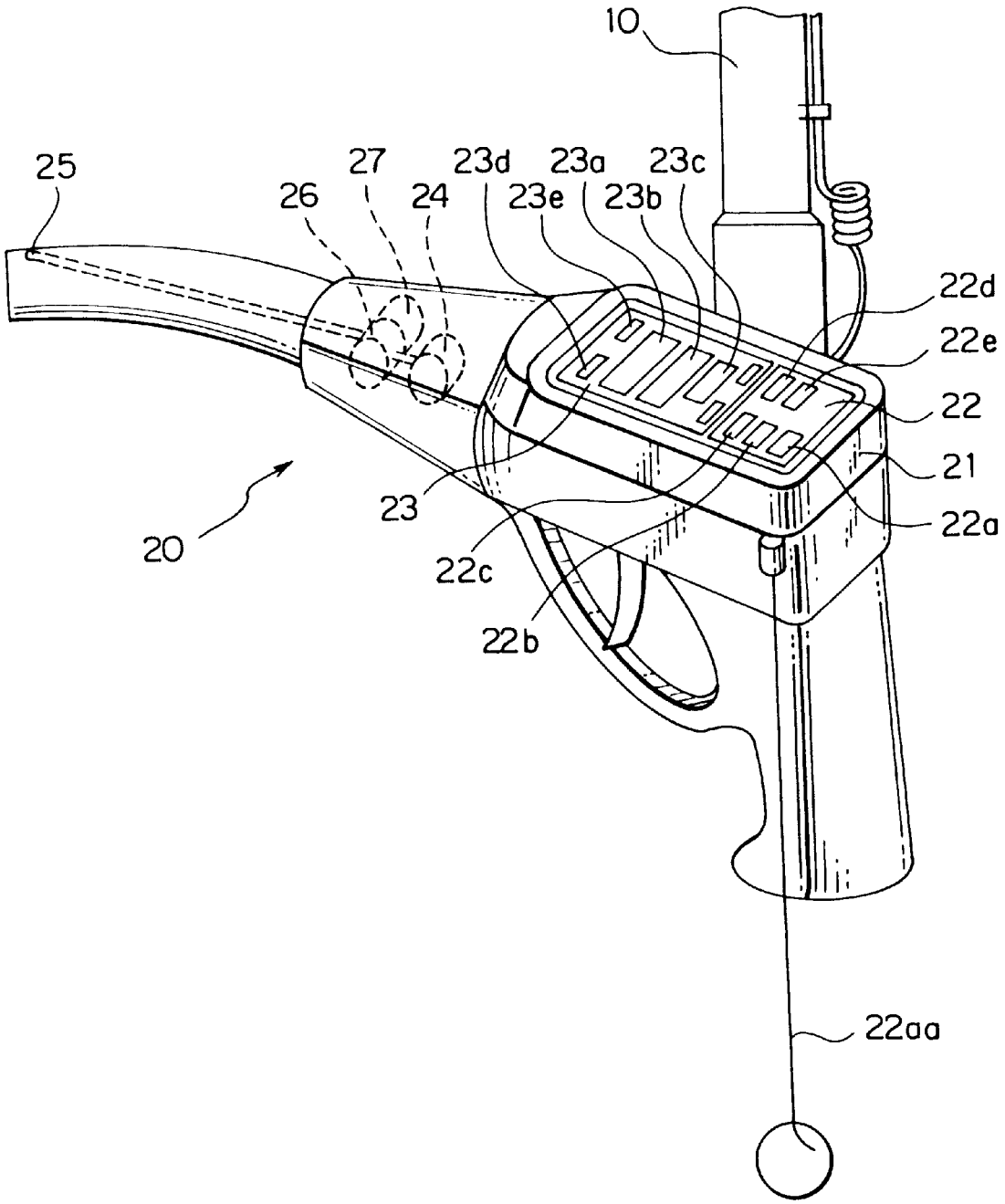
FIG. 3 is a perspective view of a fueling nozzle for use in the present invention.

As shown in FIG. 3 which is a perspective view of a fueling nozzle 20 for use in the present invention, a fueling operation unit 21 is adjusted to the fueling nozzle 20 on a hose 10. The fueling operation unit 21 has an input panel 22 comprising an ascent-descent switch 22*a* which outputs ascent and descent signals for ascending and descending of the fueling nozzle 20; a first combined-use-switch 22*b* for suspending oil discrimination and performing rounding off of fueling; a second combined-use-switch 22*c* for giving instructions of automatic fill-up fueling and preset fueling; a first designation switch 22*d* for designating to show an amount of money to be paid as the amount with or without the tax included; and a second designation switch 23*e* for designating a continuous fueling. Moreover, an indication member 23 is contained in the fueling operation unit 21, which comprises a fueling sum indication part 23*a*, fueling oil quantity indication part 23*b*, unit price indication part 23*c*, and indication parts 23*d*, 23*e* for giving information on functioning states of the fueling system.

Furthermore, the fueling nozzle 20 contains an oil discrimination sensor 24, an air pump 26 for transmitting a vapor absorbed from an opening 25 at the tip to the oil discrimination sensor 24, and a reversibly rotatable air pump motor 27 for driving the air pump 26 as shown by broken lines in FIG. 3.

The above-described all units are connected to the control unit 30. The most important part of the suspended type fueling system of the present invention is a part relating to the first combined-use-switch 22*b* for suspending the oil discrimination and performing rounding off of fueling, so that a further explanation is omitted as to the second combined-use-switch 22*c* for giving instructions of automatic fill-up fueling and preset fueling, and the first designation switch 22*d* for designating to show the amount of money to be paid as the amount with or without the tax included, and the second designation switch 23*e* for designating a continuous fueling.

Figure 4:
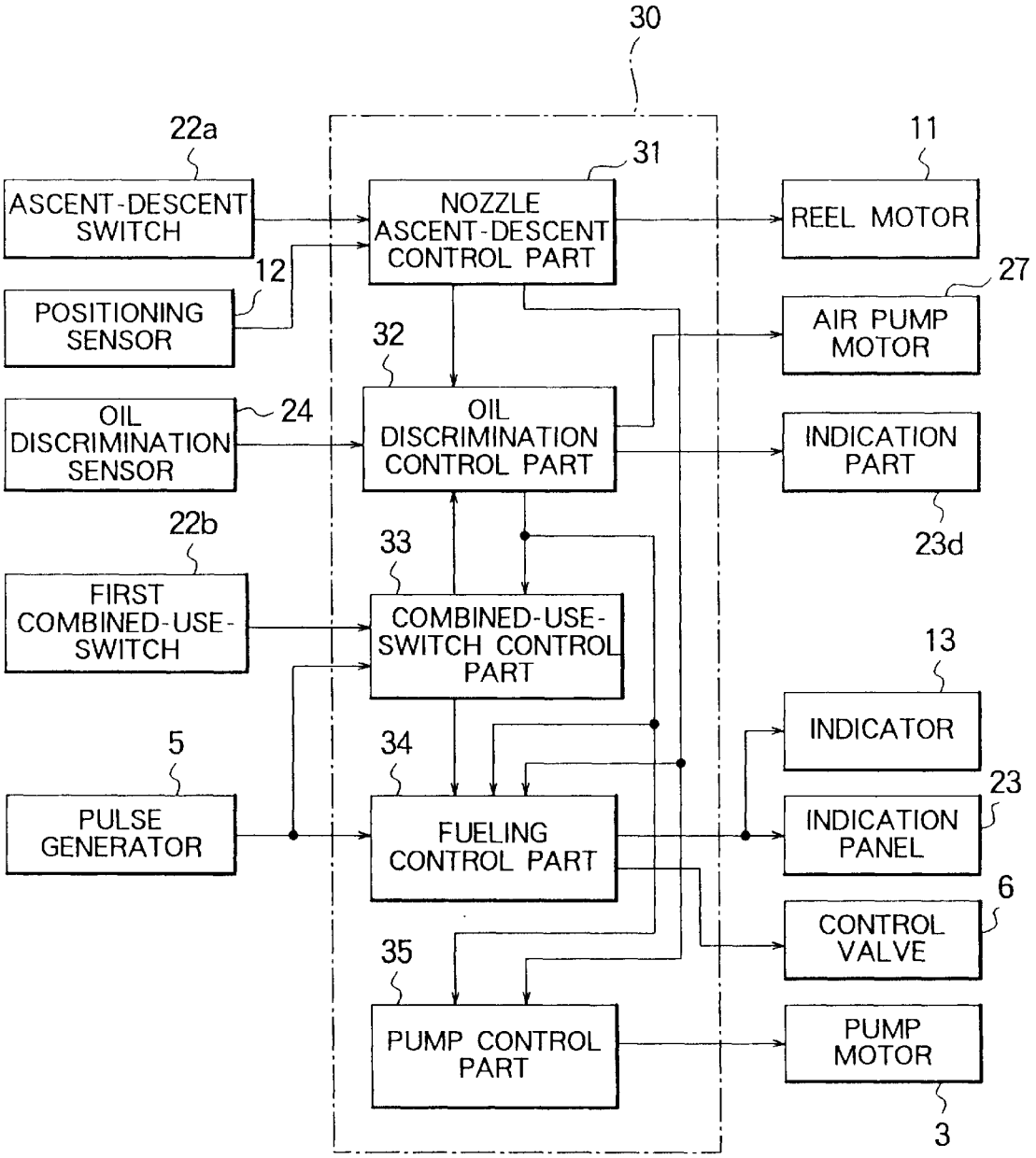
FIG. 4 is a block diagram of a control unit for use in the present invention.

FIG. 4 is a block diagram of the nozzle ascent-descent control part 31 provided in the control unit 30. The nozzle ascent-descent control part 31 rotates the reel motor 11 in a positive direction until a signal from the positioning sensor 12 shows to have the fueling position B by the receipt of an ascent positioning signal from the positioning sensor 12 together with "on" signal from the ascent-descent switch 22*a*. Then, an oil discrimination instruction signal is conveyed to an oil discrimination control part 32 when the fueling position B is attained. A fueling completion signal is conveyed to a fueling control part 34 and a pump control part 35 by the receipt of an "on" signal of the ascent-descent switch 22*a*, and then the reel motor 11 is rotated in a negative direction until the positioning sensor 12 gives a signal for placing the nozzle 20 at an ascent position A upon the receipt of an "on" signal of the ascent-descent switch 22*a* and the fueling positioning signal from the positioning sensor 12.

The oil discrimination control part 32 administrates oil discrimination, which outputs the positive rotation signal to the air pump motor 27 by the receipt of an oil instruction discrimination signal from the nozzle ascent-descent control part 31. Subsequently, the kind of oil contained in the selected oil reservoir is compared with an oil signal for showing the kind of oil from the oil discrimination sensor 24. A fueling start signal is conveyed to the combined-use-switch control part 33, fueling control part 34 and a pump control part 35 when the signal from the oil discrimination sensor 24 and the oil to be fueled are consistent with each other. On the other hand, an indication signal is output to the indication part 23*d* of the fueling operation unit 21 in the case where the kind of oil to be fed and the signal are inconsistent, or the consistency therebetween cannot be recognized.

The fueling start signal is conveyed to a combined-use-switch control part 33, fueling control part 34 and pump control part 35 when the oil discrimination unnecessary signal is output from the combined-use-switch control part 33, followed by the reversed rotation signal being input to an air pump motor 27 for exhausting gas in the sensor 24.

The combined-use-switch control part 33 outputs the oil discrimination unnecessary signal to the oil discrimination control part 32 when the signal from the first combined-use-switch 22*b* is input prior to receiving the fueling start signal from the oil discrimination control part 32, and the combined-use-switch control part 33 also outputs the rounding off fueling signal to the fueling control part 34 when the signal is input from the first combined-use-switch 22*b* during the fueling suspension period with the fueling start signal having been received and pulses have not been input from the pulse generator 5.

The fueling control part 34 performs rounding off fueling, by which control part 34 a control valve 6 is opened with the fueling data indicated on the indicator 13 and indication member 23 returned to zero by the receipt of the fueling start signal from the oil discrimination control part 32, figures showing the fueling sum of money or quantity are determined with the fractions being rounded off under receiving the rounding off signal from the combined-use switch control part 33, the control valve is closed when the amount of oil corresponding to the figures are fed, and the control is finished by the receipt of the fueling completion signal from the nozzle ascent-descent control part 31. Here, fueling data during fueling are obtained from flux pulses by the pulse generator 5 being converted, and indicated on the indicator 13 and indication member 23.

The pump control part 35 outputs a starting signal to the pump motor 3 when receiving the fueling start signal from the oil discrimination control part, and suspends the starting signal when receiving the fueling completion signal from the nozzle ascent-descent control part 31.

The fueling operation will now be explained with reference to FIGS. 5 to 9, flowcharts for explaining functions respectively of the nozzle ascent-descent control part 31 of the control unit 30, oil discrimination part 32 thereof, combined-use-switch control part 33 thereof, fueling control part 34 thereof, and pump control part 35 thereof.

Figure 5:
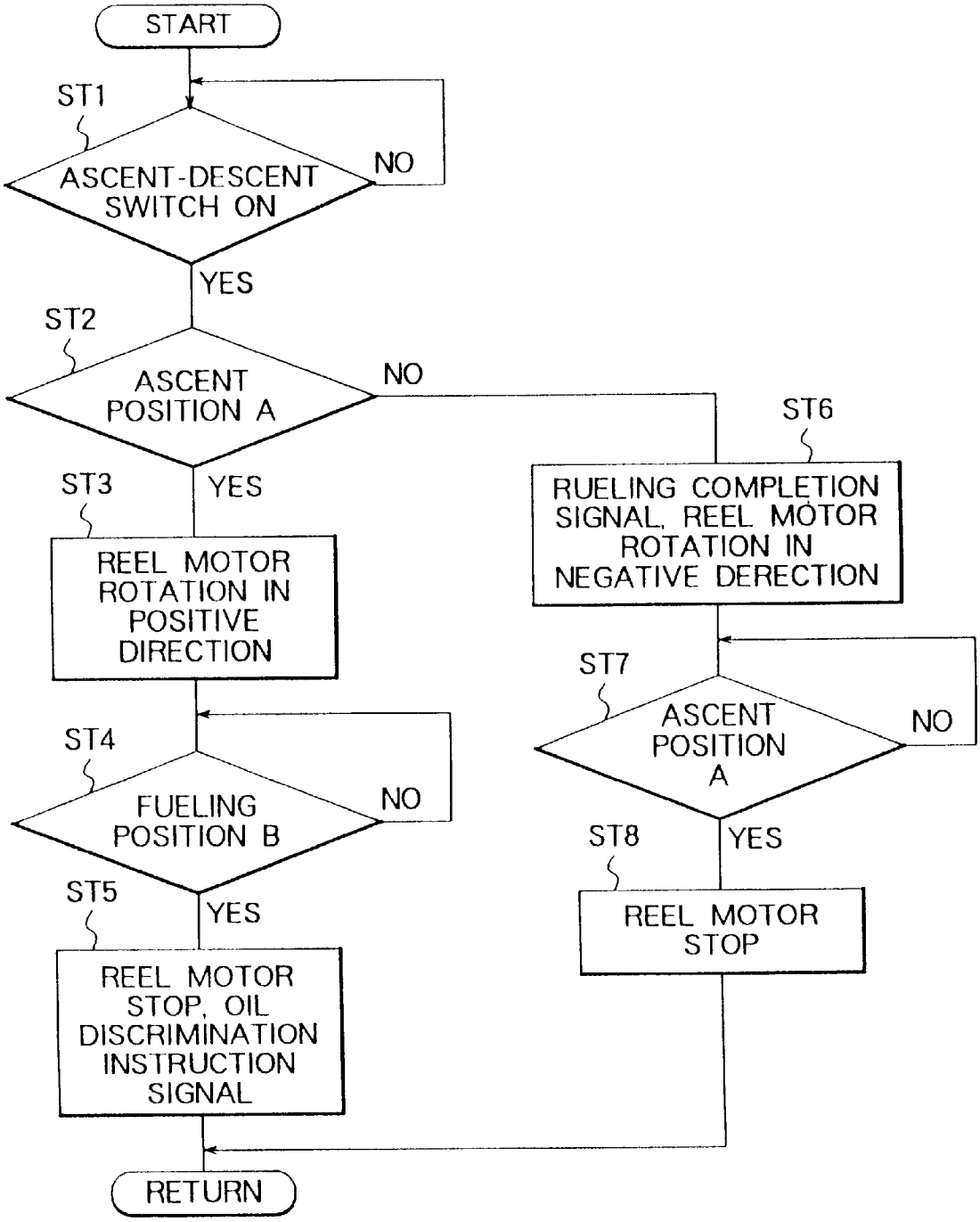
FIG. 5 is a flow-chart for explaining the general function of a nozzle ascent-descent control part in a control unit for use in the present invention.

In the first place, the ascent-descent switch 22*a* shown in FIG. 3 is closed by pulling a string 22*aa* shown in FIGS. 2 and 3 which is for controlling the ascent-descent switch 22*a* under such a state that the fueling nozzle 20 is in the ascent position A in FIG. 2, and "on" signal obtained by this action is input to the nozzle ascent-descent control part 31 of the control unit 30 (FIG. 5, ST1). At this stage, the signal from the positioning sensor 12 is for the ascent position A (FIG. 5, ST2), so that the reel motor 11 is rotated in a positive direction (FIG. 5, ST3) and the fueling hose 10 is drawn out of the hose reel 11. When the fueling nozzle 20 is descent to the fueling position B, the signal from the positioning sensor 12 is changed to one for the fueling position B (FIG. 5, ST4), the reel motor 11 is suspended, and the oil discrimination instruction signal is transmitted from the nozzle ascent-descent control part 31 to the oil discrimination control part 32 (FIG. 5, ST5). Thereafter, the fueling nozzle 20 is inserted to a fueling port of a car 40 to perform fueling.

The oil discrimination control part 32 which had received the oil discrimination instruction signal from the nozzle ascent-descent control part 31 (FIG. 6, ST1) outputs a positive rotation signal to the air pump motor 27 (FIG. 6, ST2), followed by the air pump motor 27 being rotated in the positive direction to absorb vapor of oil in the car 40 to be fueled from the opening 25 provided at the tip of the fueling nozzle 20. The absorbed vapor is detected by means of the oil discrimination sensor 27 whether the kind of oil is consistent with the kind of oil in the oil reservoir or not.

When the oil vapor is consistent with the oil to be fueled (FIG. 6, ST3), the fueling start signal is output to the combined-use-switch control part 33, fueling control part 34 and pump control part 35 (FIG. 6, ST4), a negative rotation signal is output to the air pump motor 27 (FIG. 6, ST5) to rotate the air pump motor 27 in a negative direction, thereby scavenging gas from the oil discrimination sensor 24.

Figure 6:
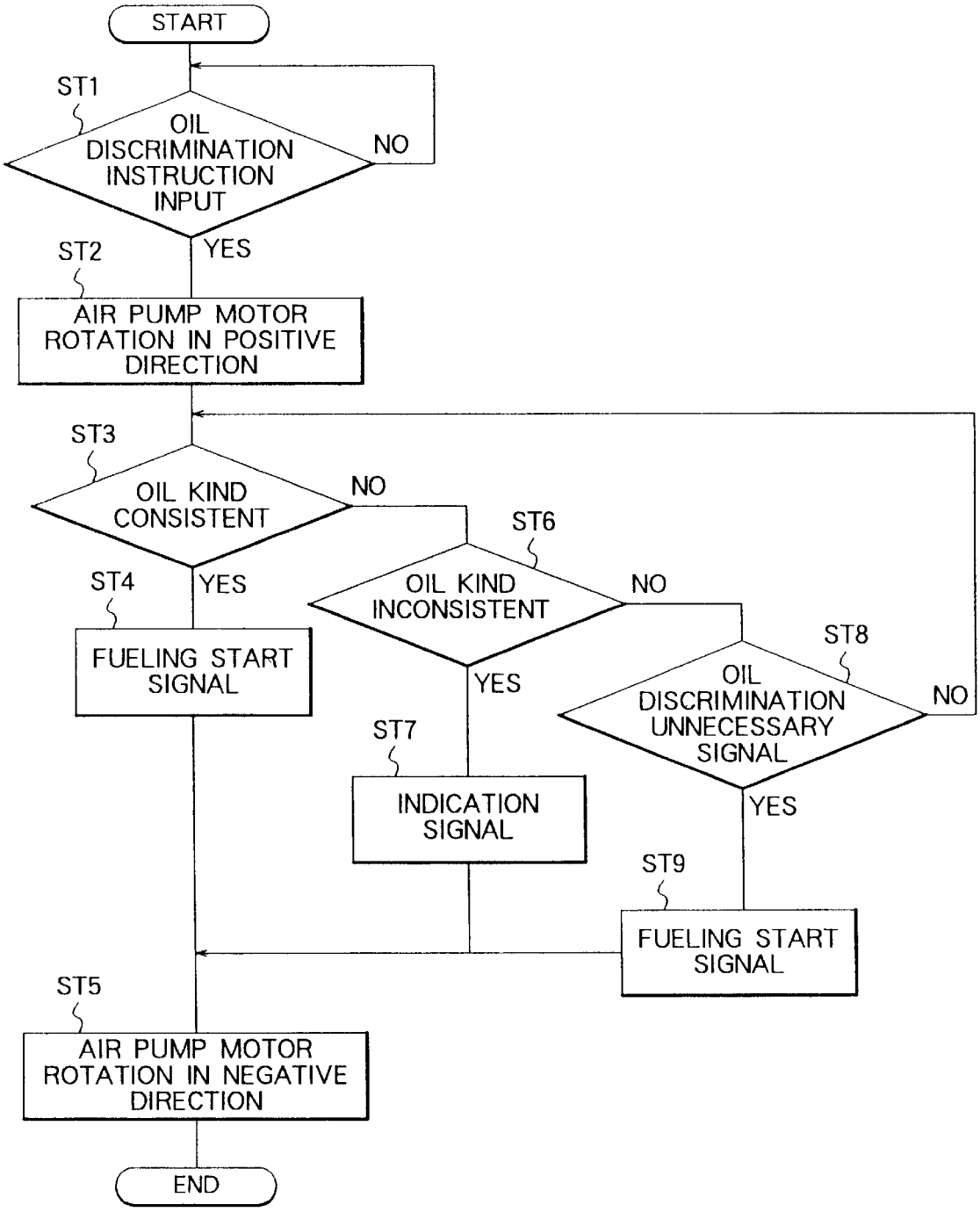
FIG. 6 is a flow-chart for explaining the general function of an oil discrimination control part in the control unit for use in the present invention.

To the contrary, if the kind of the detected oil is inconsistent with the oil to be fueled or cannot be judged what sort it is (FIG. 6, ST6), the indication signal is input to the fueling operation unit 21 of the fueling nozzle 20 (FIG. 6, ST7), the indication part 23*d* is turned on and off to notify fueling operators, and oil is scavenged from the oil discrimination sensor 24 by the rotation of the air pump motor 27 in the negative direction (FIG. 6, ST5).

Moreover, in the case where the combined-use-switch 22*b* is pressed to input an oil discrimination unnecessary signal from the combined-use-switch control part 33 (FIG. 6, ST8), the fueling start signal is conveyed to the combined-use-switch control part 33, fueling control part 34, pump control part 35 (FIG. 6, ST9), the air pump motor 27 is rotated in the negative direction without oil discrimination, and then the oil discrimination sensor 24 is subjected to gas scavenge. Thus, the oil discrimination control part 32 finishes the control.

Figure 7:
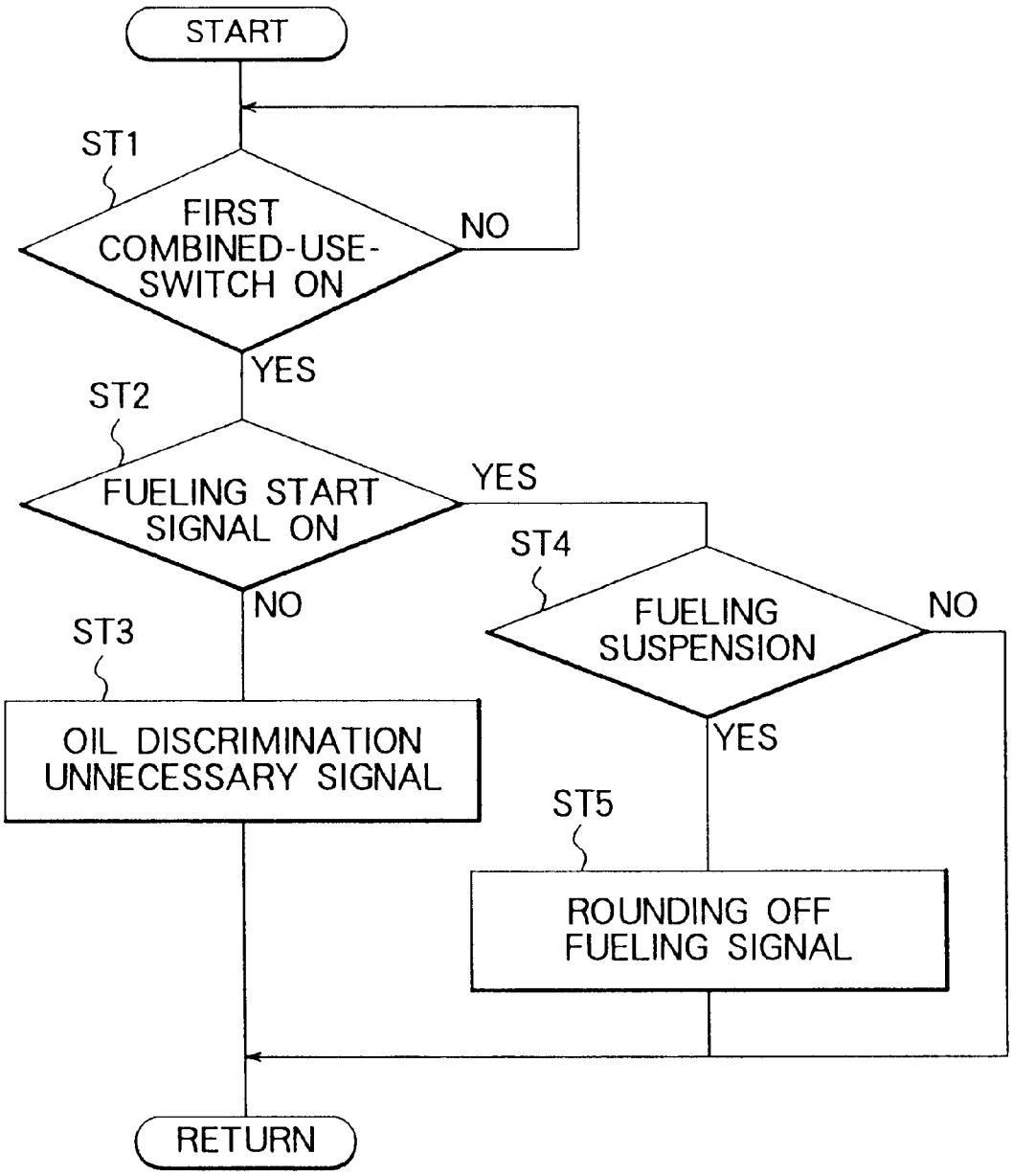
FIG. 7 is a flow-chart for explaining the general function of a first combined-use-switch control part in the control unit for use in the present invention.

Furthermore, the combined-use-switch 22*b* can be pressed (FIG. 7, ST1) in the case where fueling is performed to an oil reservoir with a shape wherein oil discrimination is difficult such as a motorcycle, or in the case where the fueling system judges the oil kind is inconsistent with that in the tank of the car 40 by indication part 23*d* being operated, although the kind of oil is actually correct. When the fueling start signal has not been input yet (FIG. 7, ST2), the oil discrimination unnecessary signal is transmitted to the oil discrimination control part 32 (FIG. 7, ST3). The oil discrimination control part 32 which have received the oil discrimination unnecessary signal stops performing oil discrimination, and transmits the fueling start signal to the combined-use-switch control part 33, fueling control part 34 and pump control part 35.

The fueling control part 34 having received the fueling start signal from the oil discrimination control part 32 (FIG. 8, ST1) outputs a reset-to-zero signal to the indicator 13 and indication member 23, and a valve-open signal is output to the control valve 6 (FIG. 8, ST2), so that the previously fueled amounts indicated on the indicator 13 and the indication member 23 are brought back to zero and the control valve 6 is opened.

Moreover, the pump control part 35 which have received the fueling start signal from the oil discrimination control part 32 (FIG. 9, ST1) outputs the starting signal to the pump motor 3 (FIG. 9, ST2), whereby oil transmission is started with the pump 2 being driven.

The flux pulses received from the pulse generator 5 of the flow meter 4 regarding fueling are converted in the fueling control part 34, and the converted fueling data is indicated on the indicator 13 and the indication member 23.

Upon fueling being performed in this way, the oil reservoir of the car 40 is almost filled up, and the fueling nozzle 20 is automatically closed by detecting the rising bubbles. For fueling with the figures indicated on the indicator 13 and the indication member 23 being rounded off, the first combined-use-switch 22*b* is pressed (FIG. 7, ST1). This time, the fueling start signal has already been transmitted to the fueling control part 34 (FIG. 7, ST2), and fueling is being suspended with the fueling nozzle 20 closed (FIG. 7, ST4), so that the combined-use switch control part 33 transmits the rounding off fueling signal to the fueling control part 34 (FIG. 7, ST5). If fueling is not being suspended (FIG. 7, ST4), the signal from the combined-use-switch 22*b* is ignored.

Figure 8:
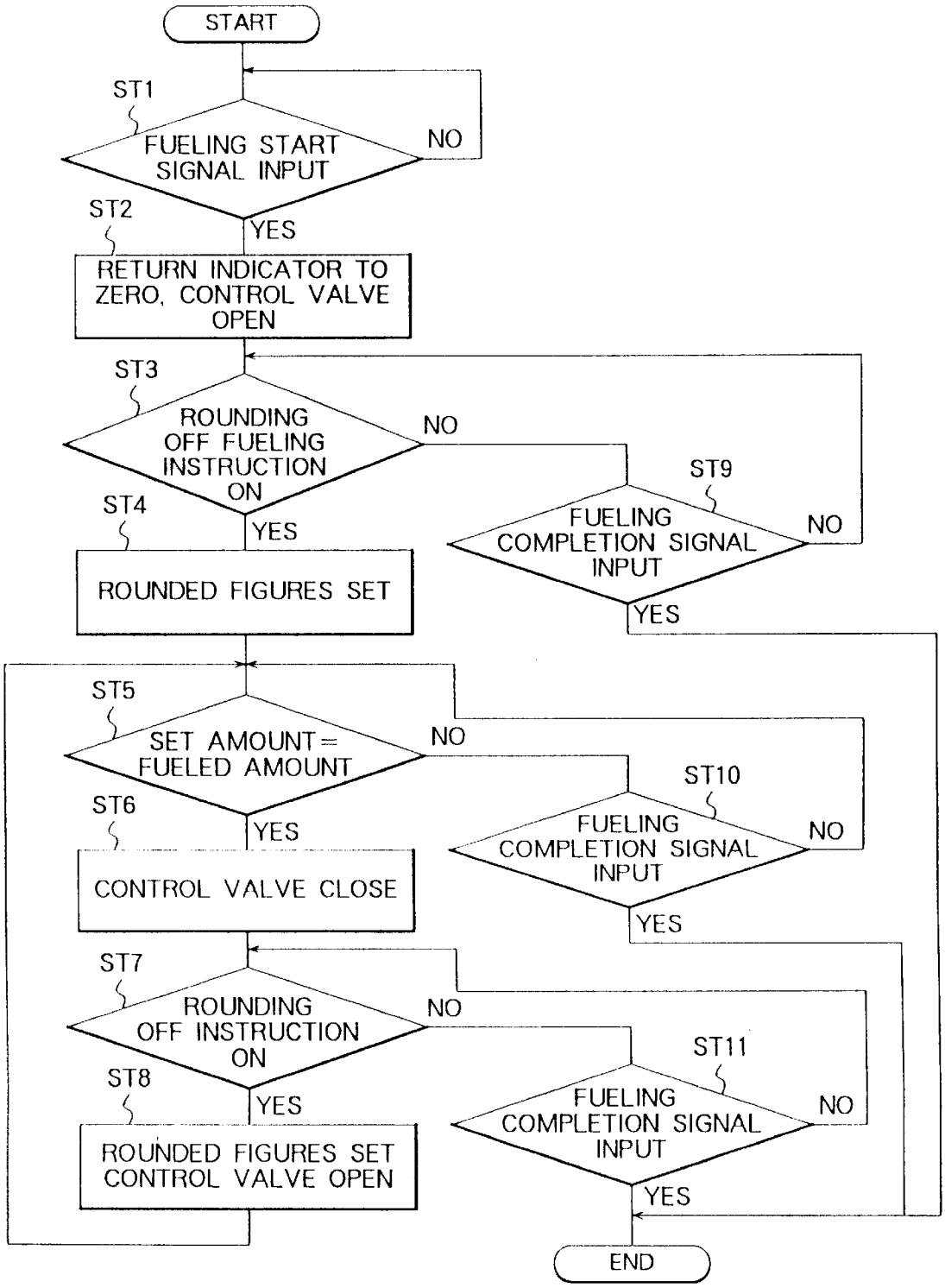
FIG. 8 is a flow-chart for explaining the general function of a fueling control part in the control unit for use in the present invention.
Figure 9:
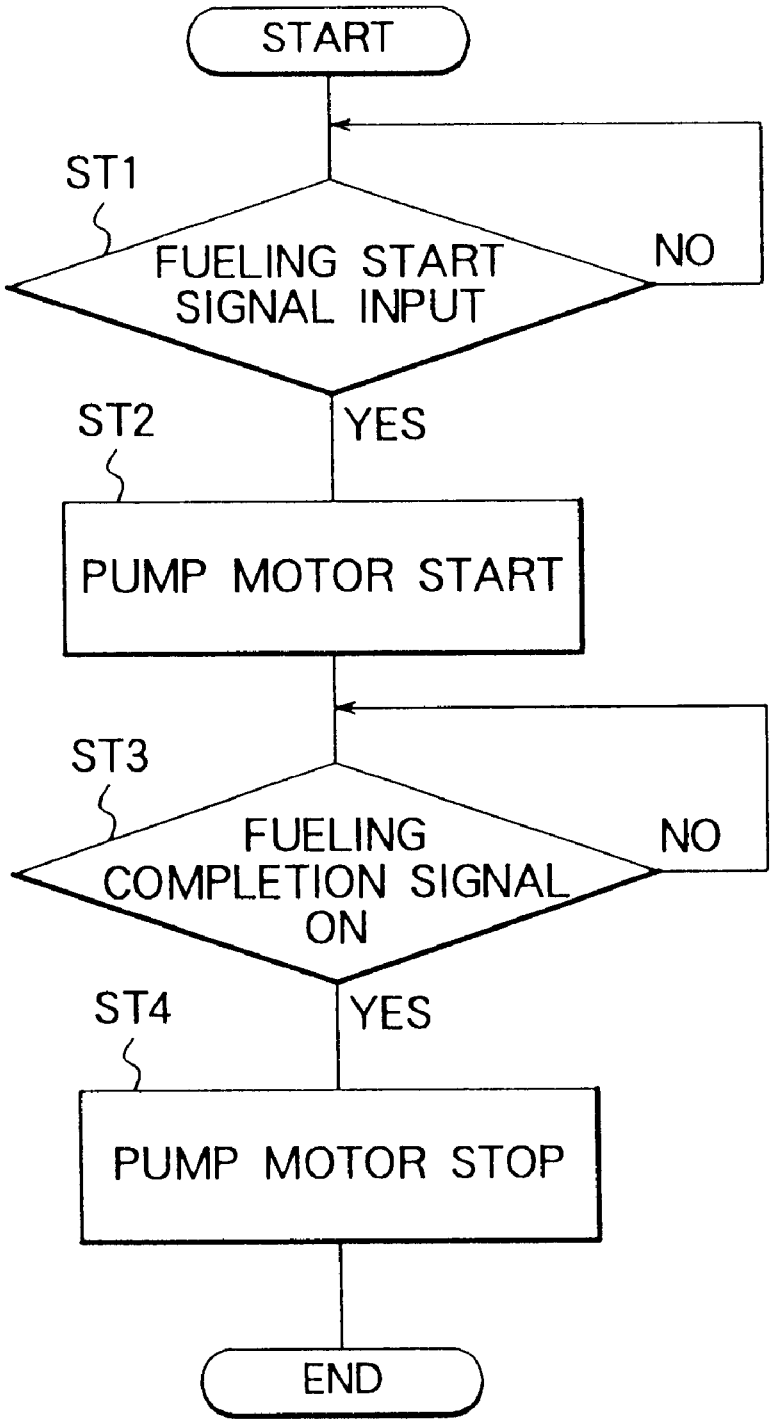
FIG. 9 is a flow-chart for explaining the general function of a pump control part in the control unit for use in the present invention.

The fueling control part 34 having received the rounding off fueling signal from the combined-use-switch control part 33 (FIG. 8, ST3) establishes a numerical value obtained by counting fractions of the fueling sum of money as a round number, for instance the numerical value wherein ¥100 is employed as the minimum unit for rounding off as a fueling fee (FIG. 8, ST4). Fueling is started again and the established numerical value has been reached (FIG. 8, ST5), whereby the control valve 6 is closed (FIG. 8, ST6). In the case where the combined-use-switch 22*b* is pressed again for additional fueling to transmit the rounding off fueling signal from the combined-use-switch control part 33 to fueling control part 34 (FIG. 8, ST7), a numerical value, for instance, with the addition of one dollar to the originally indicated value, with the control valve being opened (FIG. 8, ST8), wherein steps ST5 to ST11 shown in FIG. 8 is repeatedly performed.

Moreover, it is possible to cope with many requests of customers if the combined-use-switch is prepared as the switch alternatively indicates fueling fee and fueled quantity as round figures, for instance by the switch 22*b* continuously pressed.

With the completion of fueling, "on" signal is input to the nozzle ascent-descent control part 31 by the ascent-descent switch 22*b* being pressed (FIG. 5, ST1), the fueling completion signal is transmitted to the fueling control part 34 and pump control part 35, a negative rotation signal is output to the reel motor 11 (FIG. 5, ST6), and the fueling hose 10 is wound up onto the hose reel 9, as long as the fueling position B is maintained and the positioning sensor 12 does not output a signal for the ascent position A (FIG. 5, ST2). After the fueling nozzle 20 goes up to the ascent position A (FIG. 5, ST7), the reel motor 11 stops (FIG. 5, ST8). Thus, the control of the nozzle ascent-descent control part 31 ends.

On the other hand, when the fueling control part 34 which has received the fueling completion signal from the nozzle ascent-descent control part 31 (FIG. 8, ST9 to ST11) ends the control. Furthermore, the pump control part 35 which have received the fueling completion signal from the nozzle ascent-descent control part 31 (FIG. 9, ST3) stops outputting the starting signal to the pump motor 3 (FIG. 9, ST4), whereby the pump 2 is stopped and the control is ended.

As described above, the suspended type fueling system of the instant invention comprises a control unit for controlling oil discrimination and rounding off fueling and a fueling operation unit comprising a combined-use-switch for suspending oil discrimination and performing rounding off fueling. Therefore, the wrong kind of oil is never fed because of oil discrimination, and the liquidation treatment on the round number of fueling can be made more smoothly by the aid of the rounding off fueling function. Furthermore, it is possible to prepare a small sized fueling operation unit to be provided on a fueling nozzle since the one switch, namely the combined-use-switch covers the function of transmitting both signals for oil discrimination and rounding off fueling, and therefore the operational convenience is improved.

What is claimed is:

1. A suspended type fueling system comprising:

an oil reservoir;

a fueling tube connected to said oil reservoir at one end thereof, and extended overhead;

a fueling hose connected to said fueling tube at the other end of said fueling tube;

a pump provided on said fueling tube;

a pump motor provided on said pump for driving said pump;

a flow-meter provided on said fueling tube;

a fueling nozzle provided on said fueling hose at the free end thereof;

a control unit for controlling fueling, oil discrimination and rounding off fueling; and a fueling operation unit provided on said fueling nozzle, comprising an indication member for indicating fueling data measured by said flow meter, a nozzle ascent-descent switch for transmitting a nozzle ascent and descent signals to said control unit, and a combined-use-switch for suspending oil discrimination and performing rounding off fueling.

2. The suspended type fueling system as claimed in claim 1, wherein fueling is started without performing oil discrimination by said combined-use-switch being pressed prior to the start of fueling.

3. The suspended type fueling system as claimed in claim 1, wherein rounding off fueling is performed by said combined-use-switch being pressed while fueling suspension.

4. The suspended type fueling system as claimed in clam 1, wherein said control unit comprises a nozzle ascent-descent control part, an oil discrimination control part, a combined-use-switch control part, a fueling control part, and a pump control part.

5. The suspended type fueling system as claimed in claim 4, wherein said fueling nozzle comprises therein an air pump, an air pump motor and an oil discrimination sensor.

6. The suspended type fueling system as claimed in claim 5, wherein said oil discrimination control part outputs a positive rotation signal to said air pump motor by the receipt of an oil discrimination instruction signal, said oil discrimination sensor detects the kind of oil in a tank to be fueled, transmits a fueling start signal to said combined-use-switch control part, said fueling control part and said pump control part when the detected kind of oil and oil in said oil reservoir are consistent with one another or when an oil discrimination unnecessary signal is received from said combined-use-switch control part, transmits an indication signal to said indication member when the detected kind of oil and oil in said oil reservoir are inconsistent or when the kind of oil cannot be detected, and outputs a negative rotation signal to said pump motor for scavenging gas of oil in said oil discrimination sensor.

7. The suspended type fueling system as claimed in clam 4, further comprising a pulse generator onto said flow-meter, a control valve nearby said flow-meter and an fueling amount indicator at an upper part of a fueling area.

8. The suspended type fueling system as claimed in claim 7, wherein said combined-use-switch control part transmits an oil discrimination unnecessary signal to said oil discrimination control part when said combined-use-switch is pressed prior to the receipt of the fueling start signal from said oil discrimination control part, and transmits a rounding off fueling signal to said fueling control part while pulses from said pulse generator has not been received after the receipt of the fueling start signal.

9. The suspended type fueling system as claimed in claim 7, wherein said fueling control part opens said control valve with bringing previous fueling data indicated on said fueling amount indicator and said indication member to zero by the receipt of the fueling start signal from said oil discrimination control part, sets a round number as quantity selected from the group consisting of fueling amount of money and fueling quantity, closes said control valve when fueling corresponding to the round number is achieved, and ends the control by the receipt of a fueling completion signal from said nozzle ascent-descent control part.

10. The suspended type fueling system as claimed in claim 9, wherein said fueling control part converts flux pulses generated by said pulse generator to numbers and indicates the numbers on said fueling amount indicator and said indication member while fueling.

11. The suspended type fueling system as claimed in claim 4, wherein said pump control part outputs a staring signal to said pump motor by the receipt of a fueling start signal, and stops said pump motor by the receipt of the fueling completion signal from said nozzle ascent-descent control part.

* * * * *